US008695248B2

(12) United States Patent
Massol

(10) Patent No.: US 8,695,248 B2
(45) Date of Patent: Apr. 15, 2014

(54) PANEL COMPRISING AT LEAST ONE DISPLAY WINDOW, AND VARIOUS USES OF SUCH A PANEL

(76) Inventor: Francois Massol, Saint Bauzille de Putois (FR)

( * ) Notice: Subject to any disclaimer, the term of this patent is extended or adjusted under 35 U.S.C. 154(b) by 201 days.

(21) Appl. No.: 13/377,638

(22) PCT Filed: Jun. 7, 2010

(86) PCT No.: PCT/IB2010/052516

§ 371 (c)(1),
(2), (4) Date: Mar. 5, 2012

(87) PCT Pub. No.: WO2010/143121

PCT Pub. Date: Dec. 16, 2010

(65) Prior Publication Data

US 2012/0148766 A1 Jun. 14, 2012

(30) Foreign Application Priority Data

Jun. 13, 2009 (FR) ..... 09 53958

(51) Int. Cl.
*G09F 7/00* (2006.01)

(52) U.S. Cl.
USPC ..... 40/488; 40/375

(58) Field of Classification Search
USPC ..... 40/375, 124.08, 486, 488, 491; 434/405; 446/147, 149, 151
See application file for complete search history.

(56) References Cited

U.S. PATENT DOCUMENTS

| | | | | |
|---|---|---|---|---|
| 1,787,569 | A | 1/1931 | Deutschmeister | |
| 2,988,845 | A * | 6/1961 | MacDougall et al. | 40/445 |
| 4,441,270 | A * | 4/1984 | Crowell et al. | 40/534 |
| 7,415,789 | B2 * | 8/2008 | Hluchan | 40/488 |
| 8,272,154 | B2 * | 9/2012 | Sapp et al. | 40/491 |
| 2005/0223605 | A1 | 10/2005 | Jewitt | |

FOREIGN PATENT DOCUMENTS

| | | | |
|---|---|---|---|
| GB | 191107624 | A | 3/1912 |
| GB | 485994 | A | 5/1938 |
| GB | 2336129 | A | 10/1999 |
| JP | 2001039053 | A | 2/2001 |

* cited by examiner

*Primary Examiner* — Joanne Silbermann
(74) *Attorney, Agent, or Firm* — Bachman & LaPointe, P.C.

(57) ABSTRACT

A panel has at least one viewing window cut made in a front sheet to view illustrations and/or texts or cover them. It has a support sheet glued behind the front sheet; a booklet is fixed on the support sheet, in correspondence to the window, and being smaller than the window so that it can be leafed through via that window, and a sliding shutter is placed between the support sheet and the front sheet, to close the window, in its covering position, and hide the booklet, with the sliding shutter being held in parallel guides situated between the front sheet and the support sheet very close to two opposite sides of the window. Application in particular to making books formed by assembly of several panels.

12 Claims, 6 Drawing Sheets

PANEL COMPRISING AT LEAST ONE DISPLAY WINDOW, AND VARIOUS USES OF SUCH A PANEL

BACKGROUND

The present invention concerns a panel containing at least one viewing window, to view illustrations and/or texts, and various applications of such a panel, such as in particular a book formed of several such panels.

Systems of cards or panels shaped to enable display of different drawings in a given window, by moving a sliding mask activated by a tab that can be moved by hand, have been known for a long time. Such systems are intended especially for children, thanks to their play aspect of discovering hidden drawings by moving the tab that activates the mask. Such systems are described in particular in JP2001039053 or GB191107624, or also in US2005/0223605. Generally, these systems only enable viewing of two images alternately, in one or other of the extreme positions of mask movement. Another system, such as that described in GB2336129 for example, enables display of an image by swivelling of a panel bearing that image, with the swivelling in turn being caused by moving a tab.

Furthermore, systems with multiple books, such as that described in GB485994 for example, which combine several small booklets on a given support, have also been known for a long time. These booklets have several pages, so they enable viewing of larger numbers of different drawings or texts. However, all the booklets are accessible simultaneously, so there is no longer the interest of discovering a hidden drawing such as those in the aforementioned systems. The aim of these systems of assembled booklets is rather to provide simultaneous access to different aspects of a given subject, with each booklet corresponding to one of these aspects.

SUMMARY OF THE INVENTION

The purpose of the present invention is to propose a new display system, enabling several images and/or texts to be shown in a given window, while maintaining the amusing aspect of discovery, by requiring actions on the user's part, such as those consisting of moving a tab, as set out above.

With these objectives in mind, the object of the invention is a panel with at least one viewing window cut out of a front sheet, to view or hide images or written texts.

In the invention, the panel is characterized by the fact that it has a support sheet placed behind the front sheet; a booklet, which can be made up of several sheets, is fixed on the support sheet, in correspondence to the said window, the booklet being smaller than the window so that it can be leafed through via the said window, and a sliding shutter is placed between the support sheet and the front sheet to close the window and hide the said booklet when the shutter is in its covering position; the sliding shutter being held in parallel guides located between the front sheet and the support sheet, very close to two opposite sides of the window.

The panel in accordance with the invention thus provides access, in a given window, to the various pages of a given booklet. It maintains the amusing aspect of discovery thanks to the shutter that alternately hides or reveals the booklet, enabling users to leaf through the booklet when it is visible.

The layout of the guides next to the edges of the window ensures correct guidance of the shutter as it slides, avoiding or at least limiting the risks of sticking that could occur if the shutter were to take up a slanting position, due to fact that the distance between its guides is too great. Furthermore, this enables placing of several windows, and hence several booklets, on the same panel, with identical or different window orientations and shutter sliding directions. For example, a window could be oriented in a given direction with the corresponding shutter sliding in that direction, and another window alongside the first window, with its own shutter sliding in a direction perpendicular to the said first direction. As we will see below, it is also possible to execute, on a given panel, numerous variants as to the relative window layouts and shutter sliding directions.

In accordance with a preferential execution method, several of these panels can be assembled to form a book. All the pages of that book, or only some of them, are then made up of panels in accordance with the invention; each panel can feature a different number of windows and a different window layout.

In accordance with another execution method, the panel constitutes one side of a packaging or packing unit, and in particular the main surface of a cover, in which case the booklet can be used to provide information concerning the contents of the packaging or their use.

In accordance with a particular layout, the booklet is made up of several sheets, and each sheet is fixed separately on the support sheet, in such a way that the hinge folds of the various sheets are offset from one another. The bindings of the various sheets are thus spread over a certain width instead of being lined up, and this reduces the thickness of the bindings, the usefulness of which will be seen below.

In accordance with another preferential layout, the guides are formed by strips of paper or cardboard folded over longitudinally, with the sliding shutter guided between these strips and including, towards its end constantly held in place between the front sheet and the support sheet, side tabs that extend into the guides, between their two folded sides. Thus the shutter is correctly guided in the sliding direction, and held in place in the direction perpendicular to the panel. Moreover, the strips making up the guides are folded at the ends to form sliding limit stops, with which the shutter tabs come into contact at the end of their travel, preventing the shutter from coming out of the guides.

Other characteristics and advantages are made clear in the description provided of several models of books in accordance with the invention, featuring several panels, a separate panel with numerous corresponding windows and booklets, and a packaging system containing such a panel.

BRIEF DESCRIPTION OF THE DRAWINGS

Refer to the attached drawings in which.

DETAILED DESCRIPTION OF THE PREFERRED EMBODIMENT(S)

Figure 1:
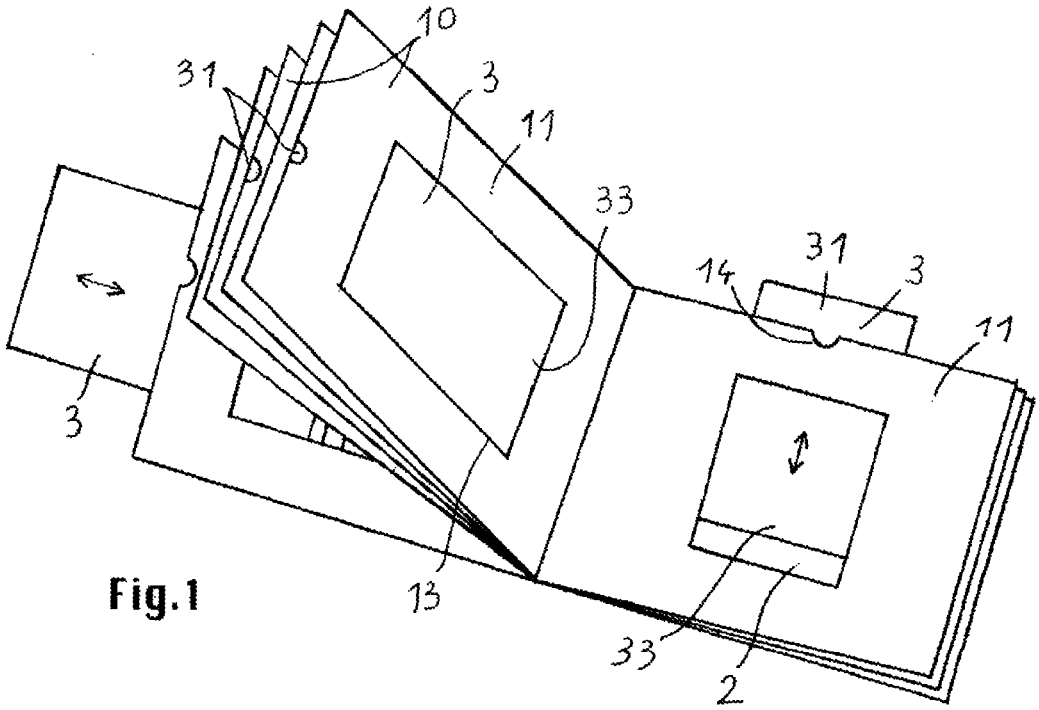
FIG. 1 is a perspective view of a book complying with the invention, represented in an open position and with the windows of the visible panels closed off by their respective shutters.
Figure 3:
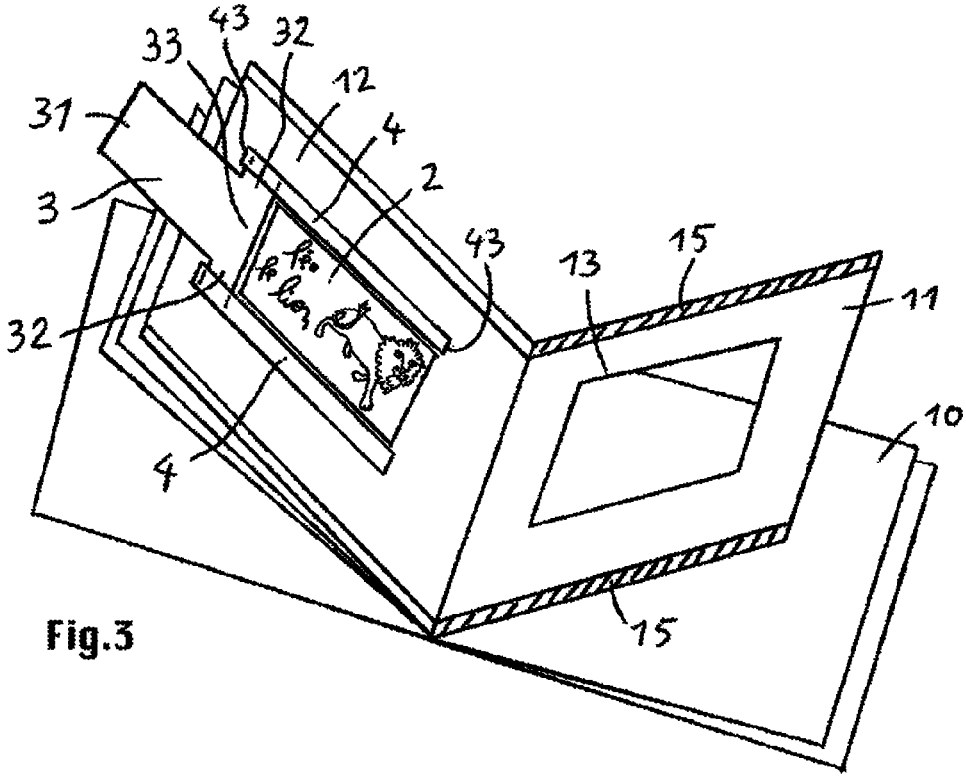
FIG. 3 is a view of the same book, in which the panel constituting the left-hand page of the previous views is shown disassembled, with the front sheet and the support sheet separated to display the guides, the booklet fixed between them, and the shutter in the open position.

FIG. 1 represents a book 1 in compliance with the invention, in the open position. The book contains several pages, bound together in the usual way, which is well known as such. Each page consists of a panel 10 with a front sheet 11, and a support sheet 12, as can be seen in FIG. 3 in particular. These sheets are made of strong paper, Bristol board, thin cardboard, etc., and assembled by gluing on their edges in the zones 15 visible in FIG. 3. At least one of the front and support sheets is strong enough to give the page as a whole sufficient rigidity to enable sliding of the shutter, as described below.

Figure 2:
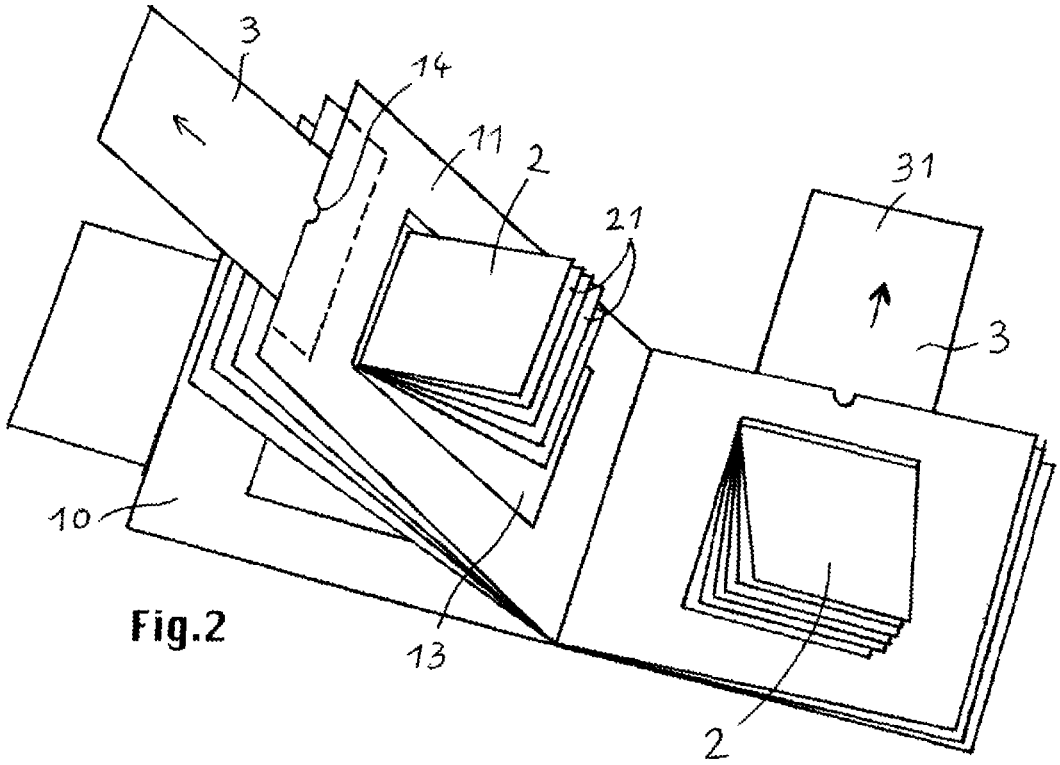
FIG. 2 is a similar view, with the shutters open and the booklets deployed.

A booklet 2, containing several sheets 21 made of fairly thin paper, is fixed on the support sheet 12. A window 13 is cut out of the front sheet 11, in a position that corresponds to the booklet 2, and with dimensions at least slightly larger than those of the booklet, to enable the booklet to be opened and leafed through via the said window 13, as illustrated in FIG. 2.

A shutter 3, made of cardboard or a similar fairly rigid material, is fitted to slide between the front sheet 11 on the one hand, and the support sheet 12 and the booklet 2 on the other hand, so that it can cover the window 13 and hide the booklet 2, which is then closed on itself. The shutter 3 is guided in translation between guides 4 placed on each side of the window, and hence also on each side of the booklet 2. One end of the shutter 3, near the edge of the page, constitutes a tab 31 to slide the shutter manually. A cut-out 14 is provided on the edge of the page for the purpose, to enable the tab 31 to be grasped when the shutter is completely closed.

Figure 6:
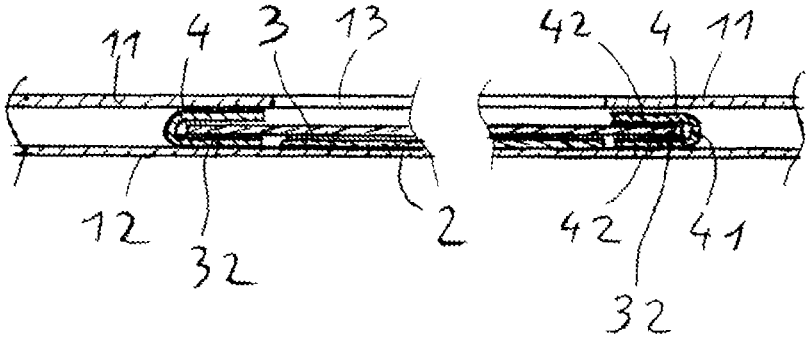
FIG. 6 is a cross-section along line VI-VI shown in FIG. 5.

The end 33 of the shutter opposite to the tab 31, that is the end located closest to the binding in the FIG. 3, has two side tabs 32 that protrude from the sides of the shutter 3 and are inserted in the guides 4. For this purpose, as shown in FIG. 6, the guides 4 feature a groove 41, preferentially obtained by folding a cardboard strip in two to constitute the said guides 4, with the folding carried out in such a way that the groove 41, between the two edges 42 of the guide thus formed, leaves a sufficient space to enable the side tabs 32 to slide along it without catching when the shutter is slid along.

Moreover, at the ends 43 of the guides, the edges 42 are folded over one another in a crosswise folding direction, to constitute limit stops for the side tabs 32, limiting the travel of the shutter 3 and preventing the side tabs 32 from coming out of the guides.

Figure 5:
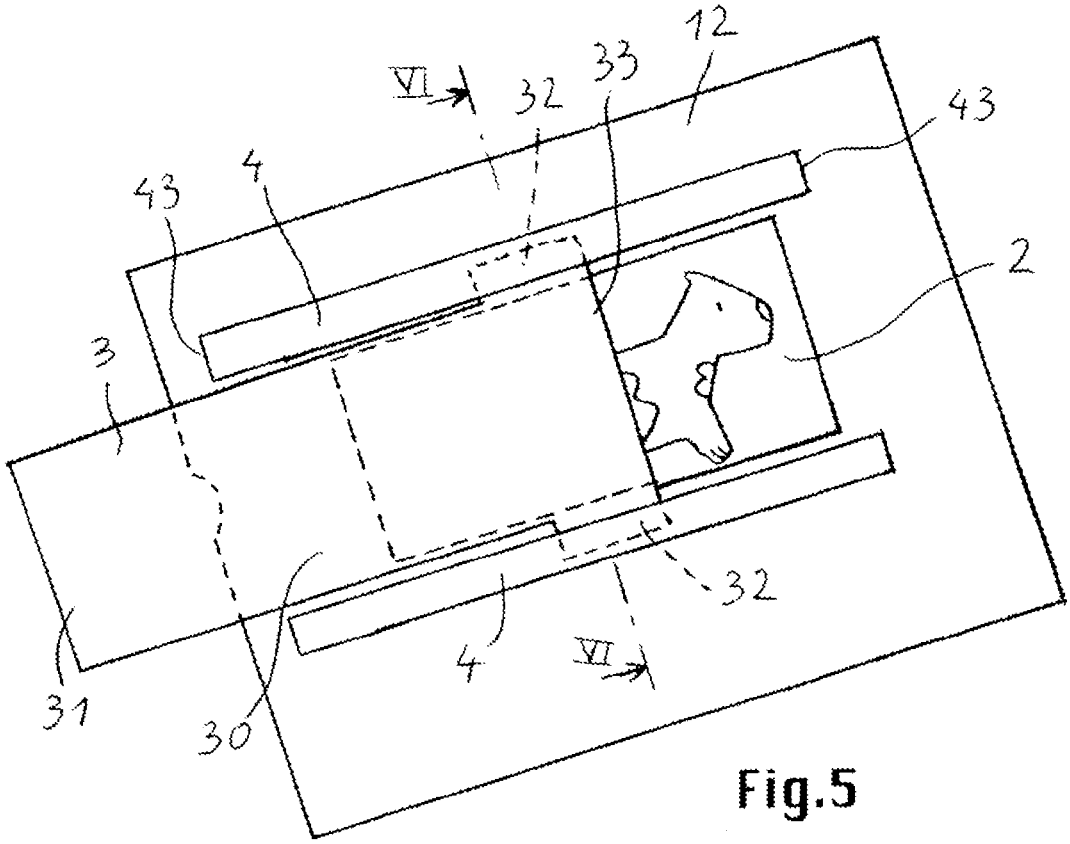
FIG. 5 is a plan view of the panel, without the front sheet, and with the shutter partially closed and covering the booklet.

The shutter 3 is thus aligned between the guides, on the one hand by its central part 30 that is held between the said guides, as can be clearly seen in FIG. 5, and on the other hand by the side tabs 32 that slide in the grooves of the guides. The fact that the side tabs are held in the guides thus enables the shutter 3 to keep the booklet 2 firmly closed, in spite of the extra thickness that the latter may constitute, especially after it has been handled several times, and this hence also avoids having the end 33 of the shutter 3 lift up, which would hamper complete closing of the shutter.

The booklet 2 can be made by simply binding or stapling its sheets along a single binding line, and fixed on the support sheet by gluing.

Figure 4:
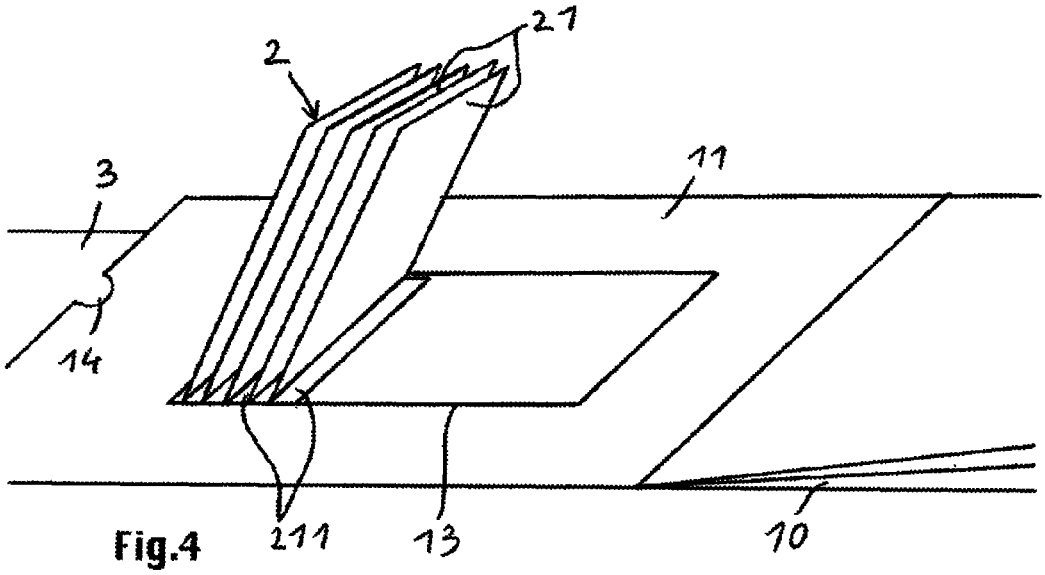
FIG. 4 shows the booklet freed by the shutter and in the deployed position, and illustrates in particular how the sheets of the booklet are fixed on the support sheet.

Preferentially, to further enhance sliding of the shutter 3, and also to limit the overall thickness of each page or panel 10, it is advantageously proposed that instead of executing the said binding, the pages of the booklet can be fixed on the support sheet separately, or at least in separate groups, with an offset in the shutter sliding direction, i.e. perpendicularly to the direction of its binding. As can be seen in FIG. 4, each sheet 21 is thus glued on the support sheet by a fixed edge 211. The sheet fixing locations are offset so that the fixed edges 211 are not superposed; this limits the overall thickness of the booklet when it is closed.

It can also be noted that, contrary to previous sliding shutter systems, the guides for the shutter 3 are placed very close to the edge of the window, hence advantageously reducing the width of the shutter and the distance between the guides, and avoids or at least considerably limits the risk of catching in the various elements if the shutter takes on a slightly skewed position. This reduction of the distance between the guides to the minimum necessary to ensure that the shutter correctly covers the window, also saves space in the plane of the sheet or panel, and facilitates placing of several windows, and the corresponding booklets, on a given page or panel, as will be seen below.

Consultation of the book is carried out as follows: it can be leafed through in the usual way, as each page 10 can have various texts and/or illustrations on the visible front sheet 11, printed in the areas surrounding the windows 13, with the latter initially closed by the shutters 3. The user can then grasp one of the tabs 31 accessible in the cut-outs 14 and slide the desired shutter 13 to reveal the booklet 2, and leaf through it. The user can then push the tab 31 back in and close the shutter again, with the edge 33 closing the booklet 2 and gradually covering it as it moves across, as shown in FIG. 5.

In the execution method shown in FIGS. 1 to 5, each page only contains one window. The shutter sliding movement can be perpendicular to the binding of the book, or parallel to it. It could also be placed obliquely.

Figure 7:
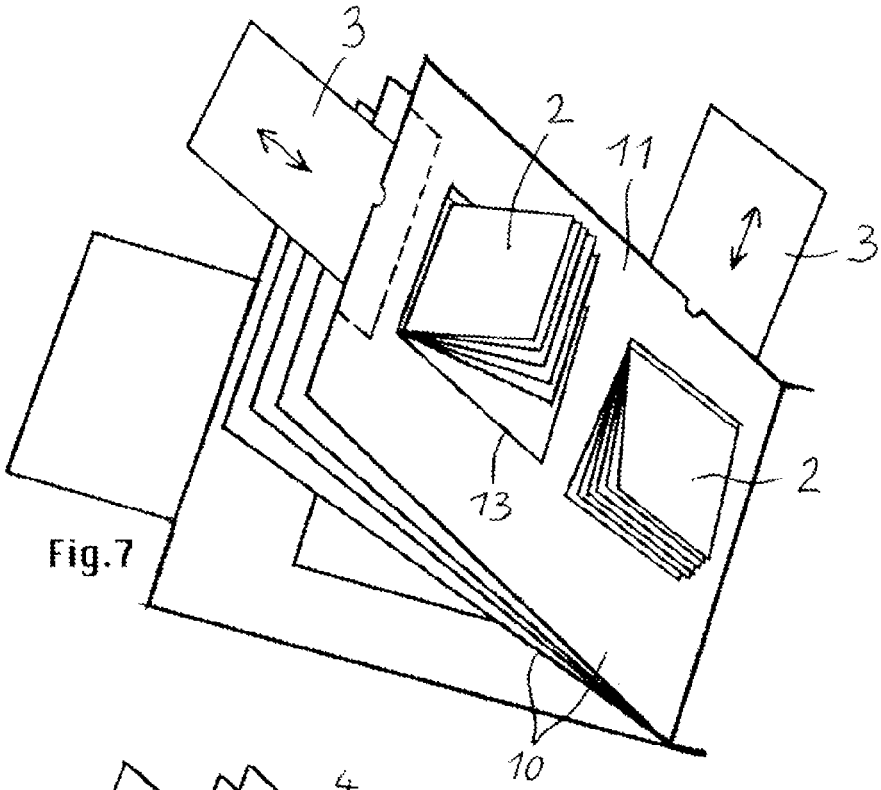
FIG. 7 shows an execution variant, in which the panel has two windows and two shutters with orthogonal sliding directions.
Figure 8:
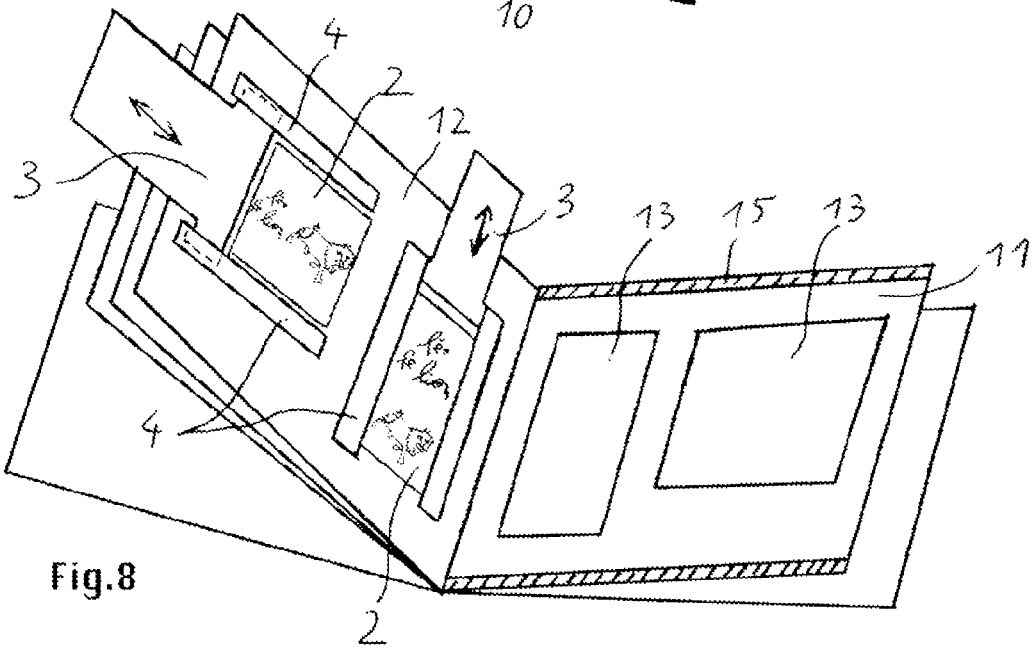
FIG. 8 illustrates the same variant, but with the front sheet separated from the support sheet.

FIGS. 7 and 8 illustrate an example in which a given page has two windows and the corresponding booklets and shutters, with the shutters sliding in perpendicular directions.

They could also slide in parallel directions, and the number of windows could be greater.

Figure 9:
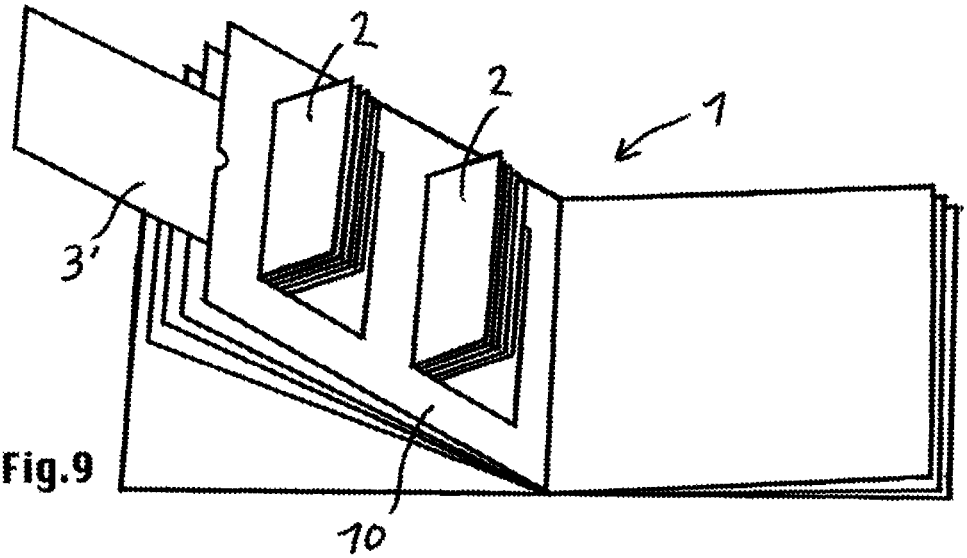
FIG. 9 shows another variant, with two windows side by side and a single shutter used for both windows.

FIG. 9 illustrates another example in which a given page has two windows, each with its own booklet, and a single shutter 3' can be used to cover both windows simultaneously, or reveal both booklets simultaneously.

Figure 10:
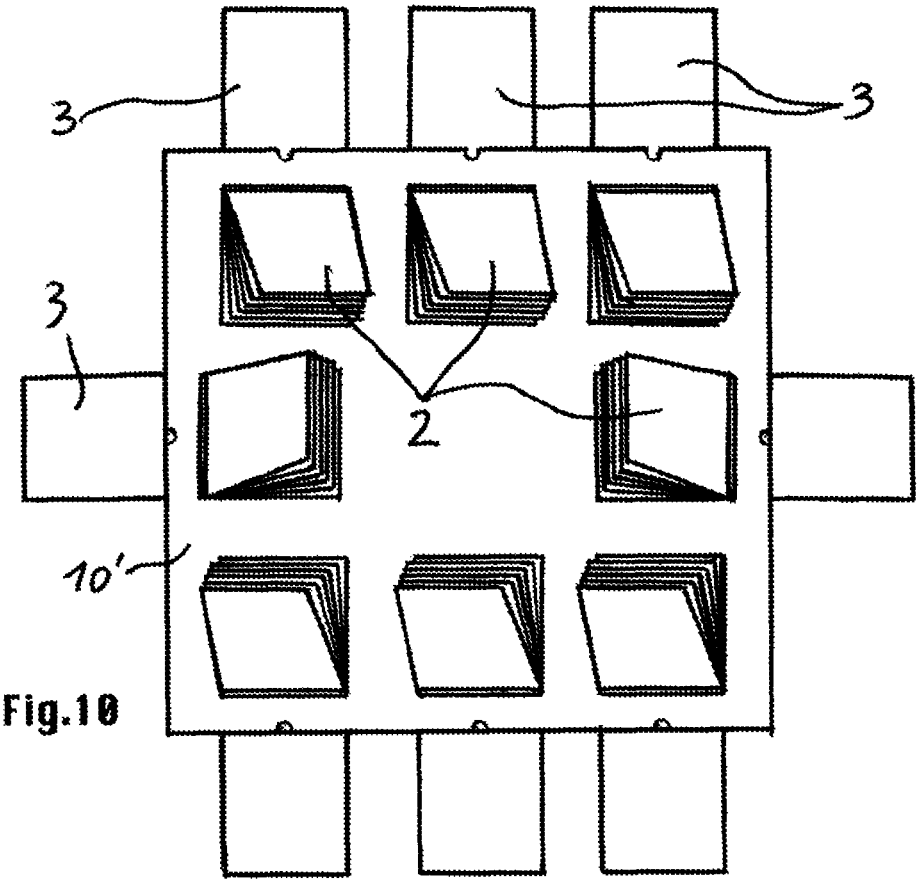
FIG. 10 shows a separate panel, with eight windows placed in various positions on its surface.

FIG. 10 shows a particular method of execution in accordance with the invention, in the form of a single large panel 10' whose front sheet features eight windows placed at various points around the surface of the panel, with each window corresponding to a booklet and having its own shutter.

Figure 11:
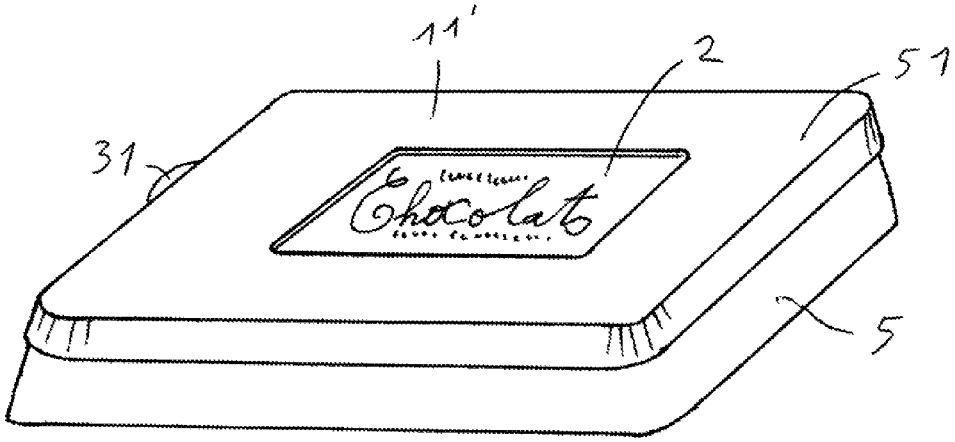
FIGS. 11 and 12 illustrate use of the panel in accordance with the invention on a box of chocolates.
Figure 12:
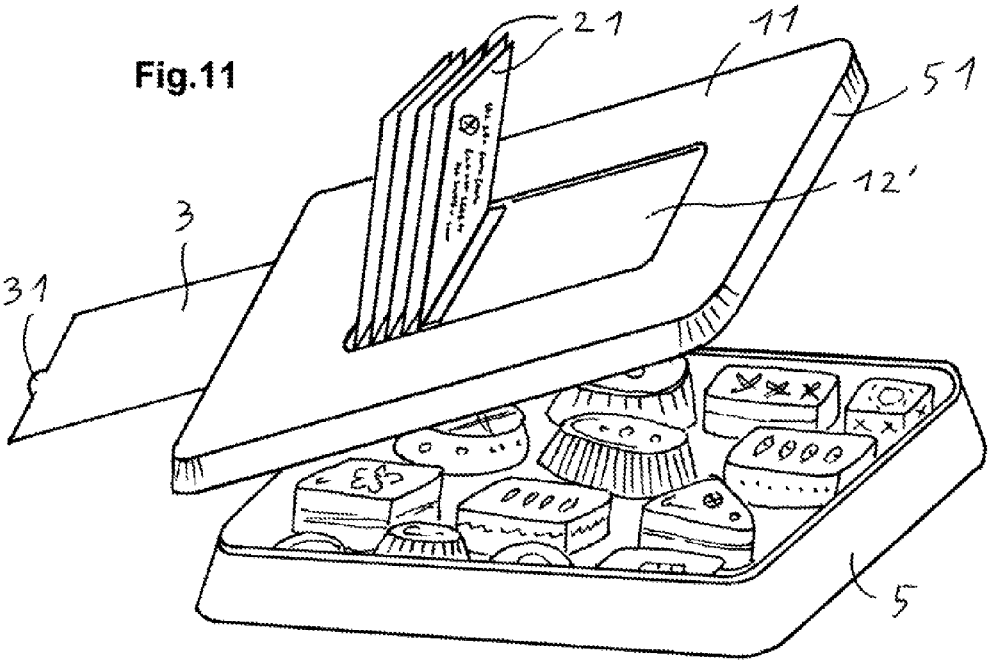

Lastly, FIGS. 11 and 12 illustrate yet another method of execution, in which the panel constitutes the cover 51 of a box of chocolates 51, with the various sheets 21 of the booklet 2 fixed on an internal wall 12' of the cover and the surface 11' of the cover constituting the front sheet in which the viewing window 13 is cut out. A cover of this type can be used on any type of packaging or packing, for foodstuffs or non-food goods. For example, the booklet 2 can provide information about the different chocolates contained in the box, or, for such other products as may be concerned, information about the product's characteristics or its use. For other packages, a similar panel can also form at least one wall of the packaging other than the cover.

The invention is not limited to the various methods of execution set out above solely to provide examples. In particular, it is possible to make numerous other arrangements of pages or panels in conformity with the invention, by modifying the number and orientation of the windows, booklets and shutters. The guides can also be made differently, while keeping the same functionalities. The booklets can also be made in different ways, for example with fold-out sheets, etc.

In a panel 10' or page 10 containing one or more booklets 2 on the front and back, the front sheets 11 are placed on each side of the support sheet 12, which is common to both sides of the page and on which the booklets corresponding to the two sides of the page are fixed. If the windows on the front and back are offset sufficiently in the plane of the page, it would also be possible to use the front sheet forming the front side of the page as a support sheet for the other side, and vice versa.

The guides can be fixed firstly on the support sheet, on each side of the booklet, as shown in FIGS. 3 and 5. Nonetheless, they could also be fixed firstly on the back of the front sheet, on each side of the window. However that may be, they can also be advantageously glued on the support sheet and on the front sheet, at the same time as the said support and front sheets are assembled, by gluing their edges.

The invention claimed is:

1. A panel comprising at least one viewing window cut out in a front sheet, to view one of the illustrations and texts or to cover one of the illustrations and texts, a support sheet glued behind the front sheet, a booklet fixed on the support sheet in correspondence to the at least one viewing window, the booklet being smaller than the at least one viewing window so that the booklet can be leafed through via said at least one viewing window, and a sliding shutter placed between the support sheet and the front sheet to close the at least one viewing window in a covering position and hide the said booklet, with the sliding shutter being held in parallel guides situated between the front sheet and the support sheet very close to two opposite sides of the at least one viewing window.

2. A panel in accordance with claim 1, wherein said panel has several windows and several booklets on the same panel with identical window orientations and shutter sliding directions.

3. A panel in accordance with claim 1, wherein said panel has several windows and several booklets on the same panel, with different window orientations and shutter sliding directions.

4. A panel in accordance with claim 1, wherein the booklet is made up of several additional sheets, and each said additional sheet is fixed separately on the support sheet.

5. A panel in accordance with claim 4, wherein each said additional sheet is fixed on the support sheet in such a way that the hinge folds of the various additional sheets are offset from one another.

6. A panel in accordance with claim 1, wherein the guides are formed by strips of paper or cardboard folded over lengthways, with the sliding shutter being guided between said strips and having, near one end maintained between the front sheet and the support sheet, side tabs protruding into the guides between two folded sides.

7. A panel in accordance with claim 6, wherein the strips making up the guides are folded over at their ends to form sliding limit stops, with which the side tabs of the shutter come into contact at an end of their travel.

8. A panel in accordance with claim 1, wherein the support sheet and the front sheet are assembled by gluing in an edge area.

9. A panel in accordance with claim 8, wherein the guides are glued on the support sheet and on the front sheet.

10. A book containing several pages, wherein at least certain pages are made up of panels in accordance with claim 1.

11. Packaging or packing having at least one wall formed by a panel in accordance with claim 1.

12. Packaging or packing having at least one wall and a cover, wherein said wall is formed by a panel in accordance with claim 1 and said cover features a panel in accordance with claim 1.

* * * * *